United States Patent [19]

Ollinger, IV

[11] 4,303,186

[45] Dec. 1, 1981

[54] TRIAXIALLY PIVOTABLE BACKPACK CARRIER

[76] Inventor: Charles G. Ollinger, IV, 912 S. Ninth Ave., Yuma, Ariz. 85364

[21] Appl. No.: 176,983

[22] Filed: Aug. 11, 1980

[51] Int. Cl.[3] ..... A45F 3/00

[52] U.S. Cl. ..... 224/211; 224/212; 224/215; 403/150; 403/157

[58] Field of Search ..... 224/211, 210, 212, 213, 224/215, 216, 271, 153, 155; 403/53, 58, 150, 157, 165, 164, 161

[56] References Cited

U.S. PATENT DOCUMENTS

| | | | |
|---|---|---|---|
| 3,031,707 | 5/1962 | Wiley et al. | 403/150 X |
| 3,493,153 | 2/1970 | Spady, Jr. et al. | 224/156 |
| 3,547,458 | 12/1970 | Price | 403/157 X |
| 3,563,431 | 2/1971 | Pletz | 224/262 |
| 3,648,907 | 3/1972 | Romney | 224/212 X |
| 3,733,017 | 5/1973 | Pletz | 224/211 |
| 3,860,157 | 1/1975 | Richards et al. | 224/211 |
| 3,889,859 | 6/1975 | Joseph | 224/211 |
| 3,938,718 | 2/1976 | Madison | 224/262 |
| 4,044,931 | 8/1977 | Catelli | 224/155 |
| 4,194,656 | 3/1980 | Zufich | 224/211 |
| 4,214,685 | 7/1980 | Pletz | 224/211 |

*Primary Examiner*—Steven M. Pollard

*Attorney, Agent, or Firm*—Cahill, Sutton & Thomas

[57] ABSTRACT

The backpack carrier permits a user to bend sideways, forward and backward without impediment. It includes a backpack frame and shoulder harness which is pivotally attached to a hip yoke through a two axis pivot member to permit pivotal movement therebetween about the vertical axis and about the horizontal axis generally perpendicular to the plane defined by the backpack frame. The ends of the hip yoke are secured to a harness locatable about the user's waist through a pivot member to permit pivotal movement of the hip yoke about the horizontal axis in the plane generally defined by the backpack frame.

5 Claims, 3 Drawing Figures

TRIAXIALLY PIVOTABLE BACKPACK CARRIER

The present invention relates to backpack carriers and, more particularly, to backpack carriers which allow freedom of movement to a user.

Most hikers and outdoorsmen prefer using backpack frames to which are strapped or otherwise attached bags and articles to be transported over ruck sacks, whether or not the latter includes internal or external frames. Various configurations of such backpack frames have been developed over the last fifteen or so years. A good cross-sectional representation of such backpack frames are illustrated and described in the following U.S. Pat. Nos. 3,493,153, 3,563,431, 3,648,907, 3,733,017, and 3,860,157. Each of the backpack frames described therein includes an essentially rigid frame which may be straight, curved in the vertical axis, curved in the horizontal axis or a combination thereof. Attachment to the user may be by shoulder straps along with a support member located at the lower end of the back frame for supporting contact upon the user's hips; or, the shoulder harness may be used in combination with a belt-like harness.

A characteristic common to each of the above described backpacks is that they impede sideways, forward and backward bending of the user's back. Accordingly, they are extremely uncomfortable to use by mountain climbers, crosscountry skiers and others who must bend their backs and torsos extensively when carrying the backpack.

In an attempt to make backpack frames more comfortable to a user when bending his back, various backpacks with a universal joint have been developed. The following U.S. Pat. Nos. 3,493,153, 3,563,431 3,648,907, 3,733,017 3,860,157, 3,938,718 and 4,044,931 are directed to backpack frames having such a joint. These backpack frame lessen the impediment to a user but incur other problems, such as substantial additional manufacturing costs, high tolerance mechanisms which are easily damaged or destroyed by rough handling of the backpack frame in the field, weight and some of them fail to provide the support sought.

The present invention overcomes the above described problems by employing a dual axis pivot member interconnecting the backpack frame with a hip yoke. The pivot member permits unrestricted twisting of the user's back about the vertical axis and sideways bending. Each of the ends of the hip yoke is secured to a belt-like harness with a pivot member which permits unrestricted forward and rearward bending of the user's back.

It is therefore a primary object of the present invention to provide a comfortable and well fitting backpack carrier.

Another object of the present invention is to provide a backpack carrier which does not impede normal three axis movement of a user's back and torso.

Yet another object of the present invention is to provide a lightweight comfortable backpack carrier.

Still another object of the present invention is to provide an inexpensive and practical backpack carrier.

A further object of the present invention is to provide a backpack carrier having a backpack frame attached to a hip yoke through a two axis pivot member.

A yet further object of the present invention is to provide a backpack carrier having a backpack frame attached to a hip yoke through a two axis pivot member and further pivot members for securing the hip yoke to a waist mounted harness.

A still further object of the present invention is to provide a backpack carrier for mountain climbers and the like who must be able to rotate their back and torso about any or all three axis without impediment.

These and other objects of the present invention will become apparent to those skilled in the art as the description proceeds.

The present invention may be described with greater specificity and clarity with reference to the drawings, in which.

Figure 1:
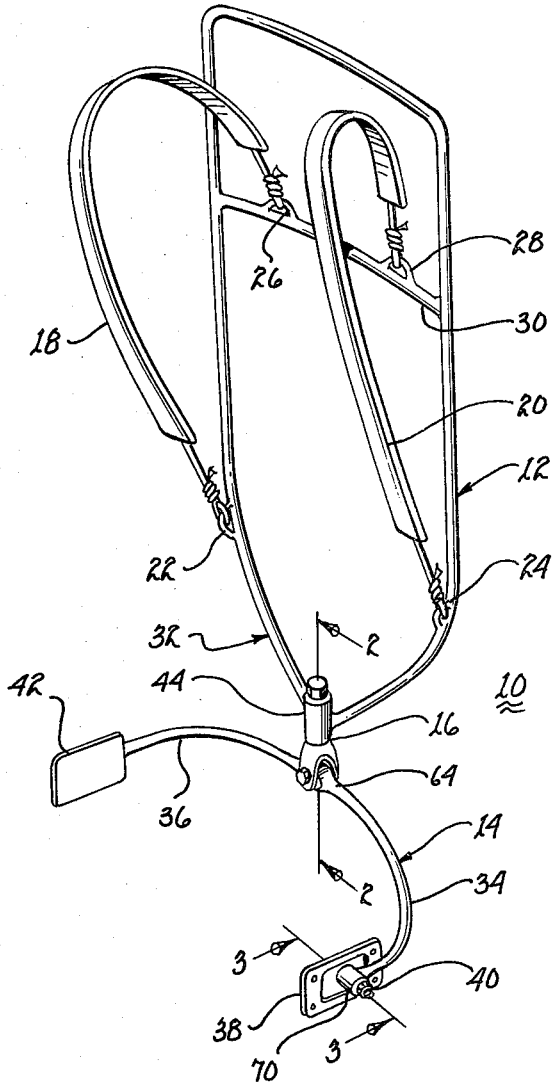
FIG. 1 is a perspective view of the backpack carrier.

Referring to FIG. 1, there is shown a backpack carrier 10 having a backpack frame 12 pivotally secured to hip yoke 14 through a two axis pivot member 16. The backpack frame includes shoulder straps 18 and 20. Suitably located attachment points 22 and 24 on the lower part of the backpack frame and attachment points 26 and 28 on cross-member 30 may be employed for permanent or detachable attachment of the shoulder straps.

The backpack frame has a generally rectangular planform with a tapered lower end 32 terminating at pivot member 16. Such a tapered lower end tends to avoid interfering engagement between the backpack frame and hip yoke 14 when the latter is pivoted with respect to the backpack frame through the pivot member. It is to be understood that the configuration, number of cross-members and number of longitudinal members of the backpack frame may be varied or altered to provide suitable supports and anchor points for the load or loads to be attached to and supported by the backpack frame. Additionally, cushions or other interfacing members may be appropriately secured along various points of the backpack frame to transmit the load comfortably to a user.

Hip yoke 14 includes legs 34 and 36 pivotally attached to and extending laterally from pivot member 16. A plate 38 is secured to the extremity of log 34 through a pivot member 40. Similarly, a plate 42 is secured to a further pivot member at the extremity of leg 36. Plates 38 and 42, in turn, are secured to a harness located about the waist of the user. Various means, such as rivets may be employed therefor.

Figure 2:
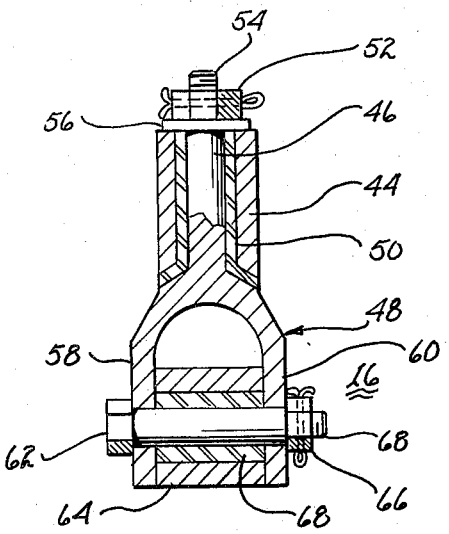
FIG. 2 is a partial cross-sectional view taken along lines 2—2, as shown in FIG. 1.

Pivot member 16 will be described with particular reference to FIGS. 1 and 2. The apex of lower end 32 of backpack frame 12 is terminated by a sleeve 44 for receiving stud 46 of yoke 48. Bearing means 50 may be disposed intermediate the sleeve and the stud to prevent binding therebetween. Stud 46 is maintained within sleeve 44 by means of a cotter pin locked nut 52 in threaded engagement with threaded end 54 of the stud. To reduce the friction intermediate nut 52 and sleeve 44, a washer 56 is employed. By this arrangement, yoke 48 is free to rotate about the axis extending through sleeve 44.

Yoke 48 includes legs 58 and 60 apertured to receive a bolt 62. Hip yoke 14 includes an enlarged section 64 disposed at its midpoint and sized to fit intermediate legs 58 and 60 of yoke 48. The enlarged section is apertured to penetrably receive the shank of bolt 62. Thereby, the hip yoke is attached to pivot member 16 and is pivotable about a horizontal axis in the place of the backpack frame. To maintain bolt 62 in place, a cotter pin locked nut 66 is in threaded engagement with threaded end 68. To reduce the friction intermediate enlarged section 64 and bolt 62, a sleeve bearing 68 may be incorporated.

From the above description, it will become apparent to those skilled in the art that hip yoke 14 is pivotally attached to backpack frame 12 to provide rotational freedom of the yoke about the vertical axis and about a horizontal axis in a plane generally perpendicular to the plane defined by the backpack frame.

Figure 3:
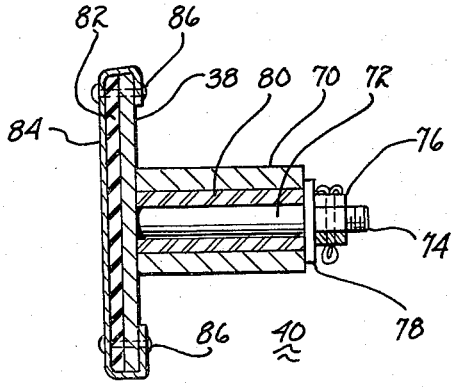
FIG. 3 is a partial cross-sectional view taken along lines 3—3, as shown in FIG. 1.

Pivot member 40 will be described with joint reference to FIGS. 1 and 3. An apertured sleeve 70 is attached to the extremity of leg 44 for receiving stud 72 extending from plate 38. End 74 of the stud may be threaded to receive a cotter pin locked nut 76. To minimize the friction intermediate the sleeve and the nut, a washer 78 may be disposed therebetween. To reduce the friction intermediate the stud and the sleeve, a cylindrical bearing 80 is employed.

Plate 38 may be attached directly to a harness disposed about the waist of the user by riveting the plate to such harness. Alternatively, a leather backing 82 may be attached to plate 38 to serve as a cushion against which a section of harness 84 is maintained by rivets 86. As illustrated, the harness may be sized to extend about and encapsulate the perimeter of plate 38 and the backing.

From the above description, it will become apparent that the hip yoke is free to pivot about a horizontal axis perpendicular to both of the axis defined by pivot member 16. Accordingly, the backpack carrier will accommodate without binding impediment practically any and all twisting or bending that a user might undergo during normal activities.

The simplicity of the backpack frame interconnection with the hip yoke and the simple attachment of the hip yoke to the harness minimizes bulk and weight and helps maintain the carrier lightweight. Additionally, the various pivot members are inexpensive and add little to the overall manufacturing cost of the carrier.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A triaxially pivotable backpack carrier, said carrier comprising in combination:

(a) a backpack frame for supporting various articles to be carried, said backpack frame including shoulder strap harnesses;

(b) a hip yoke having a pair of legs for supportedly engaging a waist harness;

(c) a first pivot member for interconnecting said backpack frame and said hip yoke and for providing pivotal movement therebetween in each of two discretely defined axis, one of the axis being generally vertical and another of the axis being generally horizontal and perpendicular to the major plane of said backpack frame; and (d) a pair of second pivot members for interconnecting said hip yoke with the waist harness and for providing the freedom of pivotal movement about a third axis, each of said second pivot members being attached to one of the legs of said hip yoke.

2. The carrier as set forth in claim 1 wherein said pair of second pivot members provides rotational freedom in a further horizontal axis generally parallel to the plane of said backpack frame.

3. The carrier as set forth in claim 2 wherein one of said pair of second pivot members is located at the extremity of each of the legs of said hip yoke and wherein each pivot member of said pair of second pivot members includes a plate for attachment to the waist harness and distribution of any imposed load to an area of the waist harness.

4. The carrier as set forth in claim 3 wherein the lower end of said backpack frame is tapered and wherein said first pivot member is disposed at the apex of said taper.

5. The carrier as set forth in claim 1 wherein the lower end of said backpack frame is tapered and wherein said first pivot member is disposed at the apex of said taper.

* * * * *